US009127877B2

(12) United States Patent
Lee et al.

(10) Patent No.: US 9,127,877 B2
(45) Date of Patent: Sep. 8, 2015

(54) REFRIGERATOR

(71) Applicant: SAMSUNG ELECTRONICS CO., LTD., Suwon-si, Gyeonggi-do (KR)

(72) Inventors: Hyung Bum Lee, Busan (KR); Jong Eun Chae, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/283,464

(22) Filed: May 21, 2014

(65) Prior Publication Data

US 2014/0375199 A1 Dec. 25, 2014

(30) Foreign Application Priority Data

Jun. 25, 2013 (KR) ..... 10-2013-0073116

(51) Int. Cl.
*A47B 96/04* (2006.01)
*F25D 25/02* (2006.01)

(52) U.S. Cl.
CPC ..... *F25D 25/024* (2013.01)

(58) Field of Classification Search
CPC ..... F25D 25/024
USPC ..... 108/63, 65, 74, 75, 143; 312/302, 306, 312/408, 404, 410
See application file for complete search history.

(56) References Cited

U.S. PATENT DOCUMENTS

| | | | | |
|---|---|---|---|---|
| 2,319,470 | A | 5/1943 | Nobles | |
| 4,620,489 | A | 11/1986 | Albano | |
| 4,923,260 | A * | 5/1990 | Poulsen | 312/408 |
| 5,641,217 | A * | 6/1997 | Caruso et al. | 312/404 |
| 8,123,315 | B2 * | 2/2012 | Hagele et al. | 312/408 |
| 8,777,341 | B2 * | 7/2014 | Amaral et al. | 312/408 |
| 8,840,205 | B2 * | 9/2014 | Chellappan et al. | 312/408 |
| 2006/0103275 | A1 * | 5/2006 | Chang | 312/290 |
| 2011/0001415 | A1 * | 1/2011 | Park et al. | 312/408 |
| 2011/0174012 | A1 * | 7/2011 | Park | 62/449 |
| 2013/0020922 | A1 * | 1/2013 | Jang | 312/408 |

FOREIGN PATENT DOCUMENTS

| | | |
|---|---|---|
| JP | 61-60086 | 4/1986 |
| JP | 7-218116 | 8/1995 |
| JP | 9-119773 | 5/1997 |
| JP | 2006-170546 | 6/2006 |
| KR | 10-2005-0071183 | 7/2005 |
| KR | 10-2006-0093052 | 9/2006 |
| KR | 10-0756887 | 3/2007 |
| KR | 10-2011-0002589 | 1/2011 |
| WO | WO 2012/062882 | 5/2012 |

OTHER PUBLICATIONS

European Search Report issued Mar. 31, 2015 in corresponding European Patent Application No. 14169373.9.

* cited by examiner

*Primary Examiner* — Matthew Ing
(74) *Attorney, Agent, or Firm* — Staas & Halsey LLP

(57) ABSTRACT

A refrigerator having a cantilever shelf which includes a pair of side frames, a fixed shelf including a rear frame that connects the pair of side frames and is coupled to a shelf coupling unit, a slide shelf provided so as to be slidably movable in forward and rearward directions between the pair of side frames, and a folding shelf rotatably provided between the pair of side frames at a rear side of the slide shelf.

18 Claims, 11 Drawing Sheets

REFRIGERATOR

CROSS-REFERENCE TO RELATED APPLICATIONS

This application claims the benefit of Korean Patent Application No. 10-2013-0073116, filed on Jun. 25, 2013 in the Korean Intellectual Property Office, the disclosure of which is incorporated herein by reference.

BACKGROUND

1. Field

Embodiments of the present disclosure relate to a shelf of a refrigerator.

2. Description of the Related Art

In general, a refrigerator is a device for keeping foods fresh using cold air generated in a refrigeration cycle. Shelves are mounted in a storage compartment of the refrigerator so that the storage compartment is vertically portioned and foods are placed on the shelves.

The present disclosure relates to a shelf of a refrigerator, and particularly, to a shelf for enabling a space to be ensured in such a manner that a part of the shelf can slide and be rotated when foods having relatively high height are stored in the storage compartment.

A variable shelf which can slide and be rotated in this manner is disclosed in Republic of Korea Patent Publication No. 10-2005-0071183, and a structure of a variable shelf including a first partition shelf that is installed so as to be rotatable with respect to a rear end of the shelf, a second partition shelf that is installed so as to be movable with respect to the first partition shelf, and a fixed shelf that supports the first and second shelves is disclosed in Republic of Korea Patent Publication No. 10-2011-002589. However, the disclosed variable shelves are provided so as to be supported by a support unit provided on a side wall of an inner box of a storage compartment.

SUMMARY

Therefore, it is an aspect of the present disclosure to provide a cantilever shelf which is supported by a rear wall of an inner box rather than a side wall of the inner box so that a part of the shelf can slide and be folded.

In addition, it is another aspect of the present disclosure to provide a cantilever shelf which includes a slide shelf provided slidably in forward and rearward directions and a folding shelf provided rotatably.

In addition, it is still another aspect of the present disclosure to provide a cantilever shelf including a slide shelf and a folding shelf, which prevents a pair of side frames of a fixed shelf for supporting the slide shelf and the folding shelf from being spread by a load.

In addition, it is yet another aspect of the present disclosure to provide a cantilever shelf including a slide shelf and a folding shelf, which prevents the slide shelf from being deviated during its movement.

Additional aspects of the disclosure will be set forth in part in the description which follows and, in part, will be apparent from the description, or may be learned by practice of the disclosure.

In accordance with one aspect of the present disclosure, a refrigerator includes: a main body; a storage compartment that is formed inside the main body; a shelf coupling unit that is provided at an inner rear side of the storage compartment; and cantilever shelves which are coupled to the shelf coupling unit to be supported, wherein the cantilever shelves include a fixed shelf that has side frames protruding forward from both sides thereof, hanger brackets which are respectively provided at the both sides of the fixed shelf so as to support the fixed shelf and having a coupling ring coupled to the shelf coupling unit, a slide shelf that is provided so as to be slidably movable between the side frames, a folding shelf that is rotatably provided at a rear side of the slide shelf between the side frames, and a spread prevention unit that prevents the side frames from being mutually spread by a load exerted on the cantilever shelves.

Also, the spread prevention unit may include first spread prevention protrusions respectively provided at both sides of the slide shelf and first spread prevention grooves respectively provided in the side frames, so that the first spread prevention protrusions are inserted into the first spread prevention grooves when the slide shelf is maximally drawn out.

Also, the spread prevention unit may include second spread prevention protrusions respectively provided at both sides of the folding shelf and second spread prevention grooves respectively provided in the side frames, so that the second spread prevention protrusions are inserted into the second spread prevention grooves when the folding shelf is unfolded.

Also, the spread prevention unit may include third spread prevention protrusions respectively provided at the both sides of the slide shelf and third spread prevention grooves respectively provided in the side frames so that the side frames are prevented from being mutually spread during movement of the slide shelf.

Also, the third spread prevention protrusions and the third spread prevention grooves may be provided long in a movement direction of the slide shelf.

Also, the refrigerator may further include an auxiliary frame that is coupled to the side frames so as to form the third spread prevention grooves.

Also, the auxiliary frame may be screw-coupled to the side frames.

Also, the slide shelf may include a first rail that protrudes sideways so that the slide shelf slides, the side frame may include a second rail that slidably supports the first rail, and the folding shelf may include a third rail that slidably supports the first rail.

Also, the refrigerator may further include a stopper unit that fixes the slide shelf in a state in which the slide shelf is maximally drawn in.

Also, the stopper unit may include a stopper protrusion provided at a front end of the first rail, and a stopper groove provided at a front end of the second rail so that the stopper protrusion is inserted into the stopper groove.

Also, the refrigerator may further include at least one support bar that connects the hanger brackets so as to support the hanger brackets, wherein the at least one support bar is arranged rearward from the slide shelf so as to prevent operations of the slide shelf and the folding shelf from being interrupted.

Also, the shelf coupling unit may include a plurality of shelf hanger grooves in which the coupling ring is inserted and fixed and which are formed so as to be mutually spaced apart from each other in a vertical direction so that heights of the cantilever shelves are adjusted.

Also, a receiving groove in which the shelf coupling unit is received and coupled may be formed at a rear wall of the storage compartment.

Also, the refrigerator may further include a cold air duct that supplies cold air into the storage compartment; and a duct cover that is coupled to the rear wall of the storage compartment so as to form the cold air duct, wherein a receiving groove in which the shelf coupling unit is received and coupled is formed on the duct cover.

In accordance with another aspect of the present disclosure, a cantilever shelf of a refrigerator includes: a fixed shelf that includes side frames protruding forward from both sides thereof; hanger brackets which are respectively coupled to the both sides of the fixed shelf and include a coupling ring that is coupled to the shelf coupling unit; a slide shelf that is provided so as to be slidably movable between the side frames; a folding shelf that is rotatably provided at a rear side of the slide shelf between the side frames; and a spread prevention unit that prevents the side frames from being mutually spread by a load exerted on the cantilever shelf.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
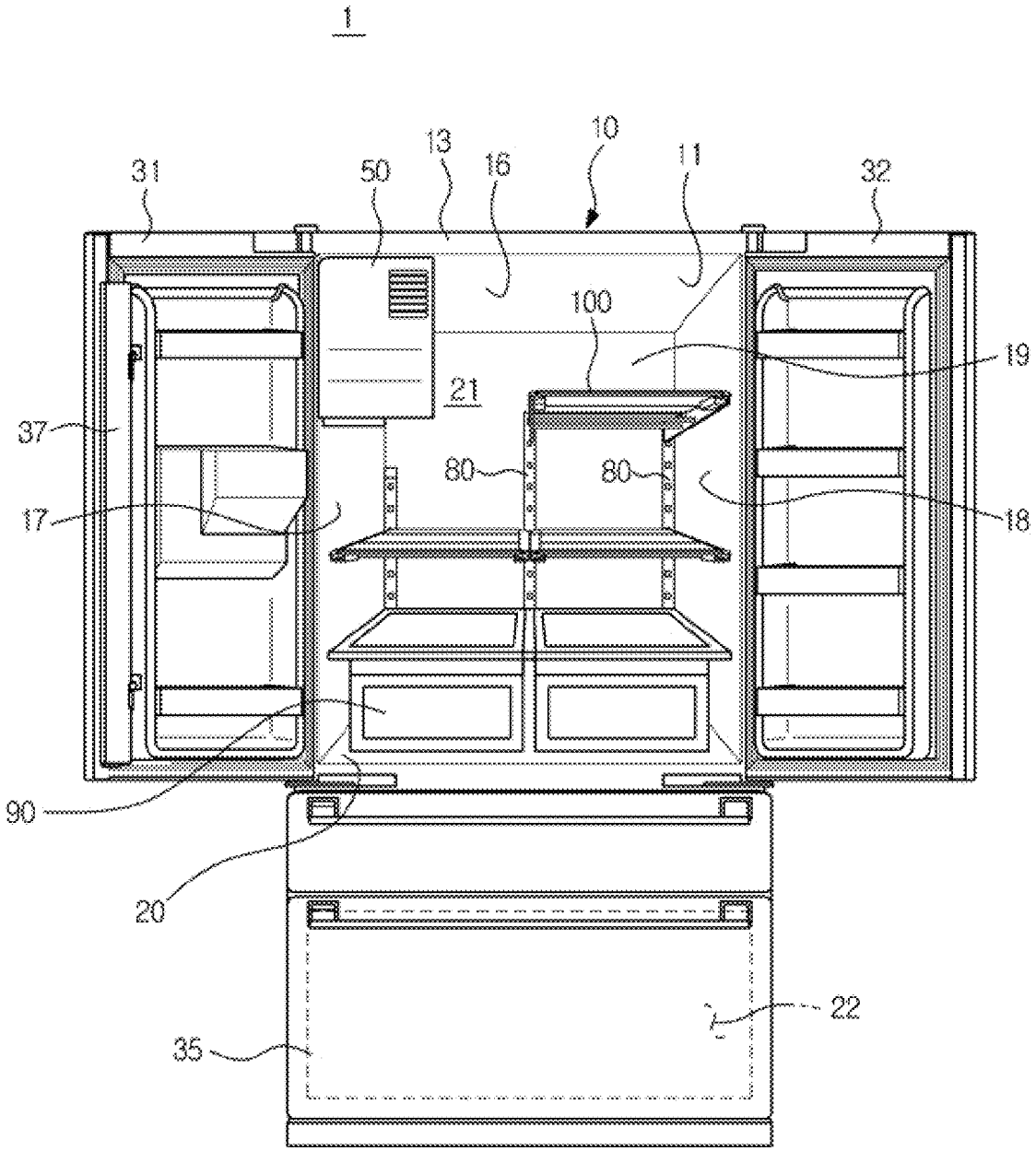
FIG. 1 illustrates an inside of a refrigerator in accordance with one embodiment of the present disclosure.

Reference will now be made in detail to the embodiments of the present disclosure, examples of which are illustrated in the accompanying drawings, wherein like reference numerals refer to like elements throughout.

FIG. 1 illustrates an inside of a refrigerator 1 in accordance with one embodiment of the present disclosure.

Referring to FIG. 1, the refrigerator 1 may include a main body 10 in which a plurality of storage compartments 21 and 22 mutually partitioned are formed, doors 31, 32, and 35 which are provided in front surfaces of the plurality of storage compartments 21 and 22 to open and close each storage compartment, a cold air supply device (not shown) for supplying cold air into the storage compartments 21 and 22, and a machine room (not shown) which is provided at a lower rear side of the main body 10 and includes electrical components such as a compressor and the like installed therein.

In addition, the refrigerator in accordance with one embodiment of the present disclosure includes a refrigeration cycle including a compressor, a condenser, an expander, and an evaporator so as to generate the cold air discharged through the cold air supply device (not shown).

The main body 10 includes an inner box 11 and an outer box 13, and a heat insulating material 15 is foamed and filled between the inner box 11 and outer box 13 of the main body 10 so as to keep heat insulation.

In addition, the main body 10 includes an upper wall 16, a lower wall (not shown), a left wall 17, a right wall 18, and a rear wall 19. In addition, the main body 10 includes an intermediate partitioning wall 20 which is disposed in parallel so as to partition the storage compartments 21 and 22.

The storage compartments 21 and 22 include a first storage compartment 21 provided in an upper portion of the intermediate partitioning wall 20 and a second storage compartment 22 provided in a lower portion thereof. The first storage compartment 21 may be configured as a refrigerator compartment whose temperature is maintained at a temperature slightly exceeding a freezing temperature, and the second storage compartment 22 may be configured as a freezer compartment whose temperature is maintained at the freezing temperature or less.

The doors 31, 32, and 35 for opening and closing the respective storage compartments 21 and 22 are provided on front surfaces of the first and second storage compartments 21 and 22. The doors 31, 32, and 35 include a pair of rotary type doors 31 and 32 for rotatably opening and closing left and right sides of the first storage compartment 21 and a drawer type door 35 for slidably opening and closing the second storage compartment 22.

The pair of rotary type doors 31 and 32 are respectively hinge-coupled to the left and right sides of the main body 10, and the drawer type door 35 is coupled to the main body 10 so as to be slidably drawn in and drawn out of the main body 10.

The first storage compartment 21 includes a relatively large storage space without being partitioned by a separate insulating partitioning wall, and a filler device 37 for sealing a gap between the pair of rotary type doors 31 and 32 for opening and closing a relatively large storage space is provided between the pair of rotary type doors 31 and 32.

An ice-making chamber separately from the first storage compartment 21 is provided in one side wall of the first storage compartment 21, for example, near an upper edge of the left wall 17 of the first storage compartment 21 to be partitioned by an insulating wall, and an ice-making device 50 for making ice may be installed inside the ice-making chamber.

In addition, a plurality of shelves on which foods and the like to be stored are placed are provided in an upper space of the first storage compartment 21 so as to efficiently use the relatively large storage space, and a sealed container 90 for sealing and storing foods is provided in a lower space of the first storage compartment 21.

The plurality of shelves may be cantilever shelves 100 which are coupled to and supported by a shelf coupling unit 80 installed in the rear wall 19 of the first storage compartment 21.

Figure 2:
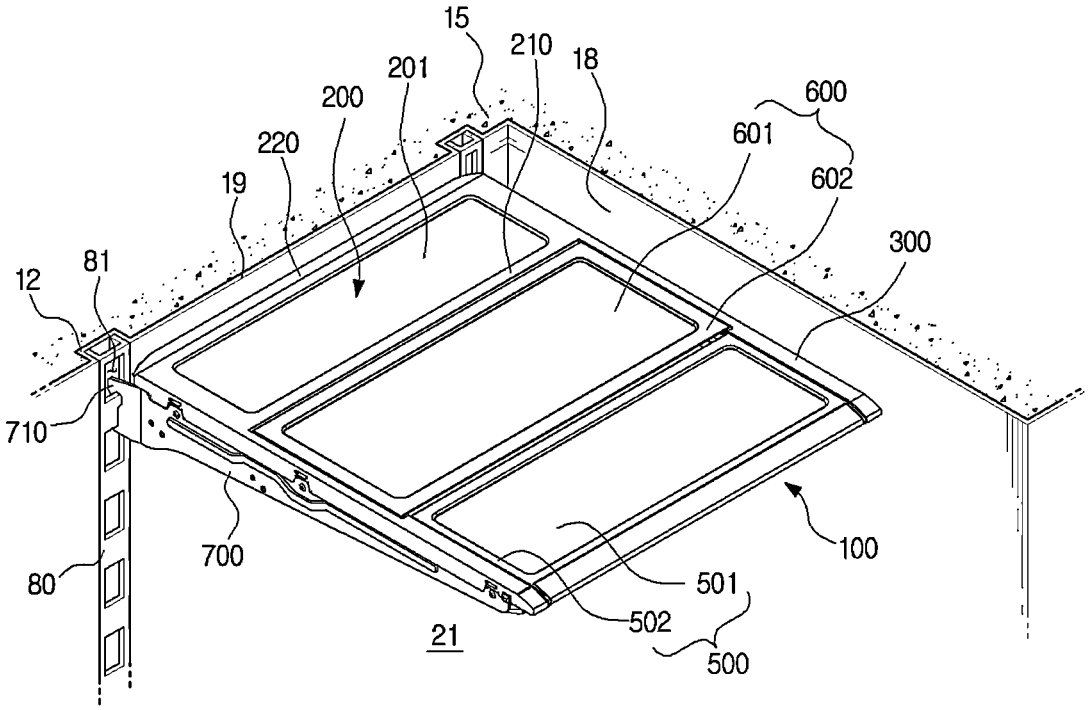
FIG. 2 illustrates a coupling structure of a cantilever shelf of the refrigerator of FIG. 1.

In the shelf coupling unit 80 to which the cantilever shelves 100 are coupled, a plurality of shelf hanger grooves 81 of FIG. 2 which are mutually spaced apart from each other in a vertical direction are provided so that heights of the cantilever shelves 100 can be adjusted.

Hereinafter, a specific configuration of the cantilever shelves 100 will be described with reference to FIGS. 2 to 8.

Figure 3:
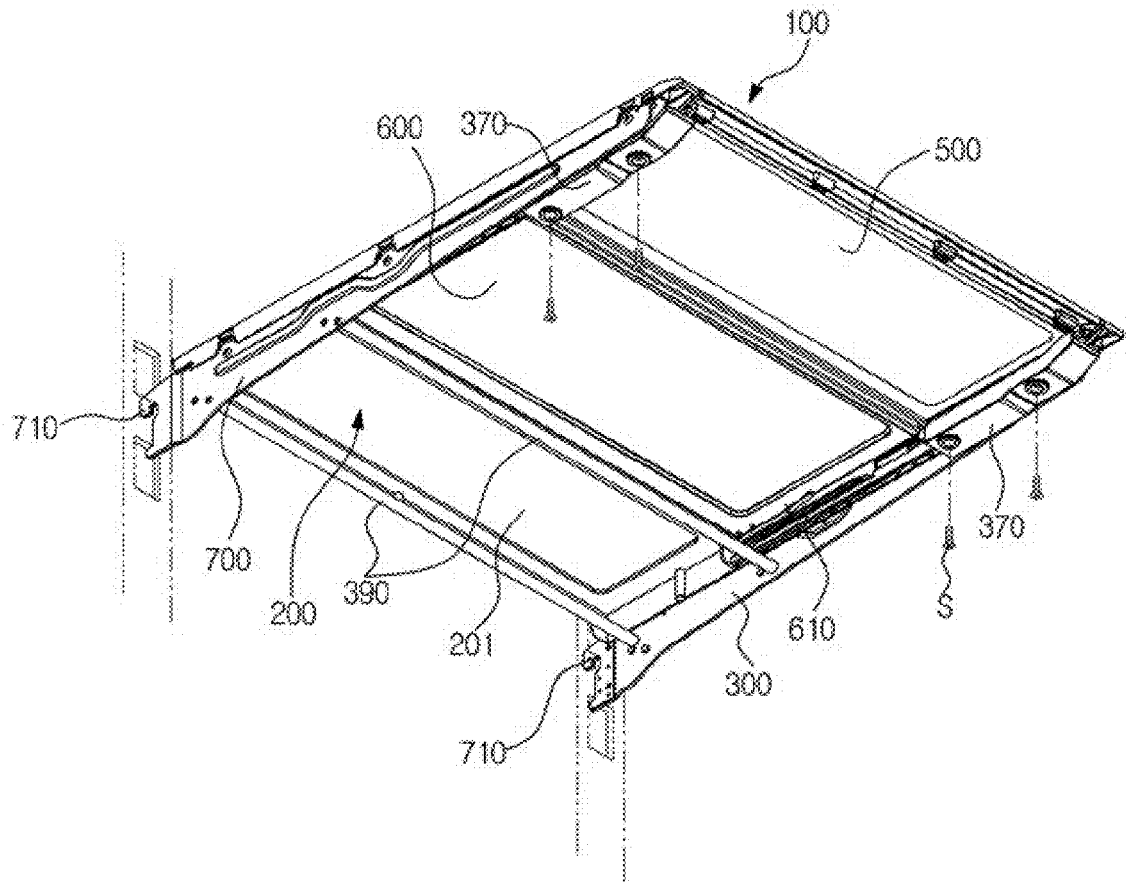
FIG. 3 is a bottom perspective view showing the cantilever shelf of the refrigerator of FIG. 1.
Figure 4:
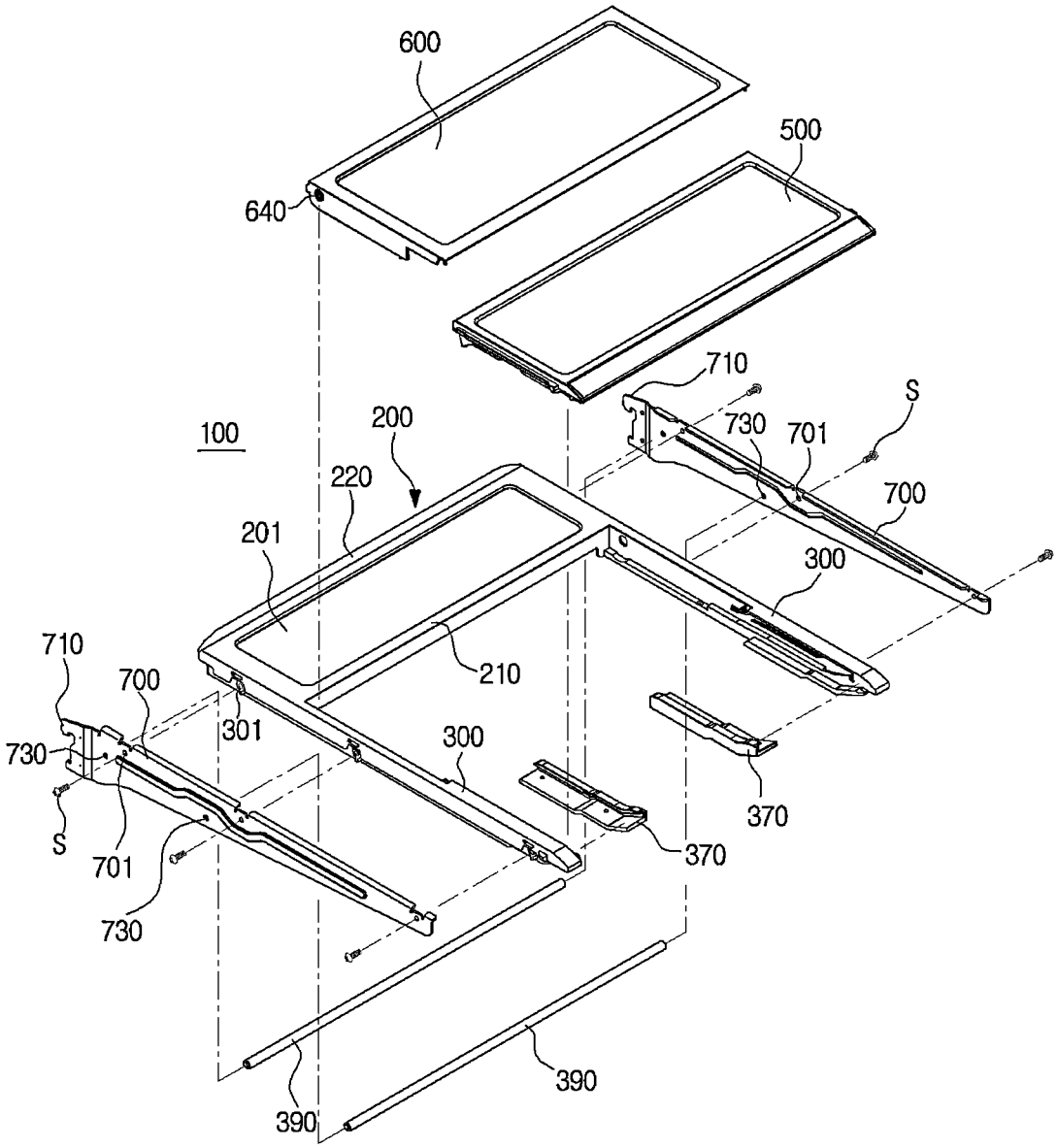
FIG. 4 is an exploded perspective view showing the cantilever shelf of the refrigerator of FIG. 1.
Figure 5:
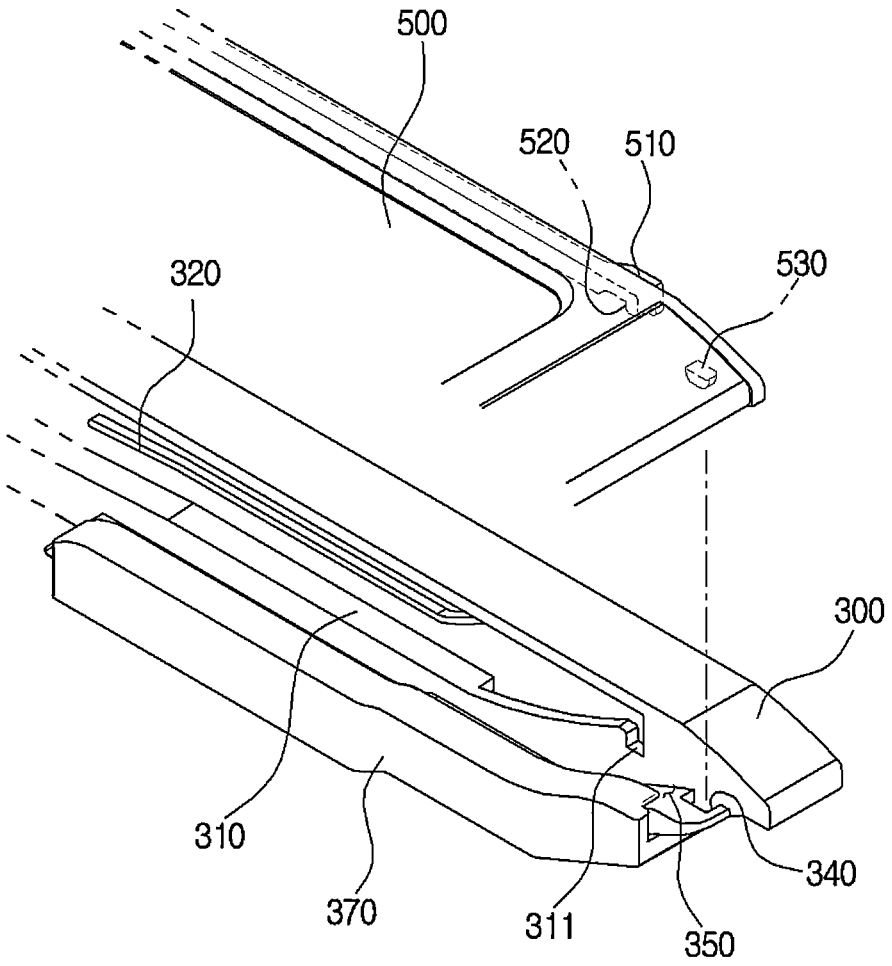
FIG. 5 illustrates structures of a first spread prevention unit and a third spread prevention unit of the refrigerator of FIG. 1.
Figure 6:
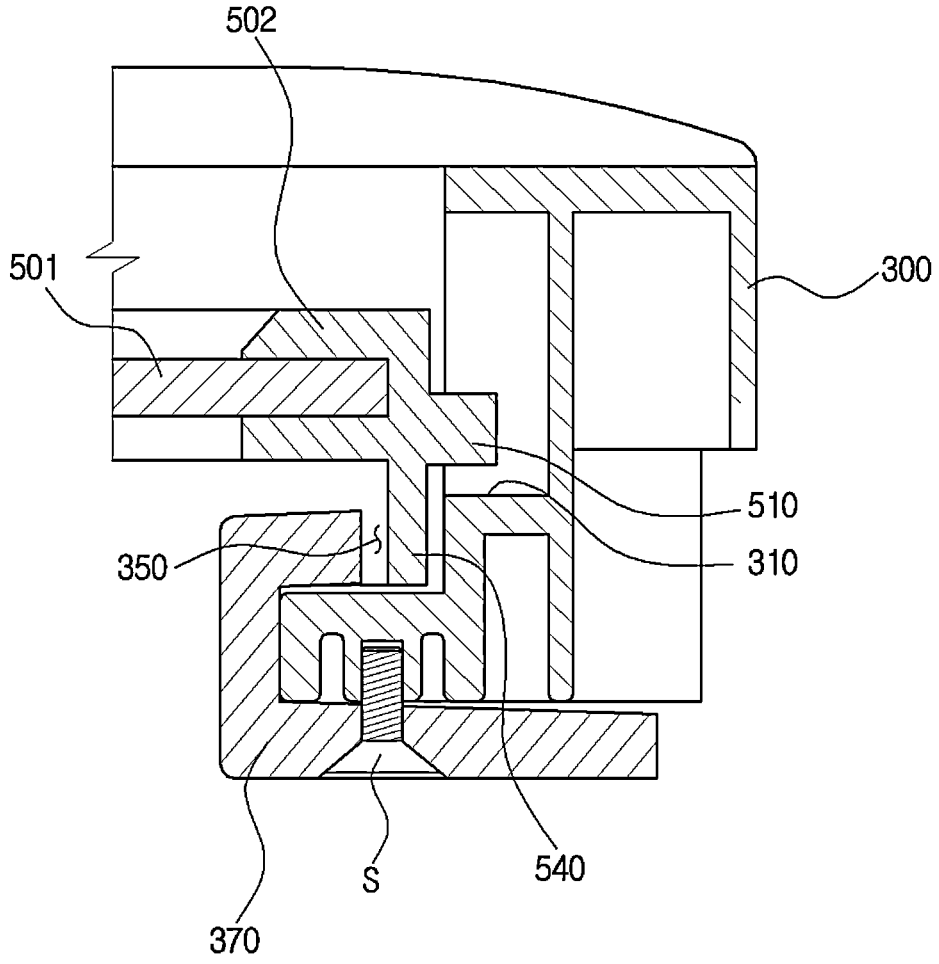
FIG. 6 is a cross-sectional view showing a structure of a third spread prevention unit of the refrigerator of FIG. 1.
Figure 7:
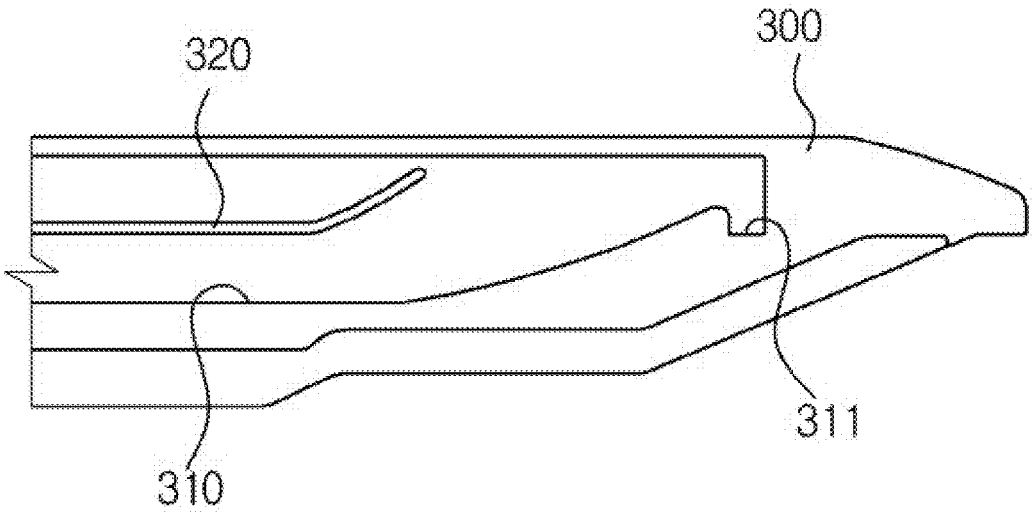
FIG. 7 illustrates a structure of a second rail of a side frame of the refrigerator of FIG. 1.
Figure 8:
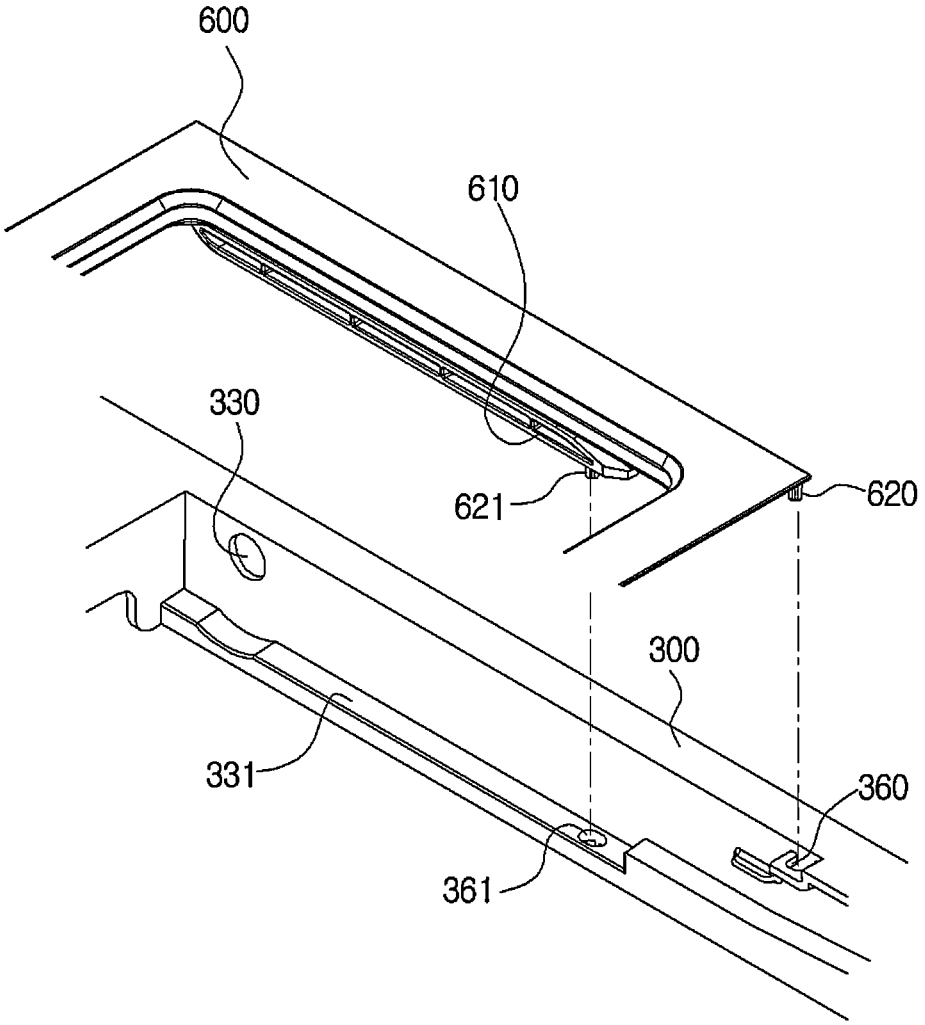
FIG. 8 illustrates a structure of a second spread prevention unit of the refrigerator of FIG. 1.

FIG. 2 illustrates a coupling structure of a cantilever shelf of the refrigerator of FIG. 1, FIG. 3 is a bottom perspective view showing the cantilever shelf of the refrigerator of FIG. 1, FIG. 4 is an exploded perspective view showing the cantilever shelf of the refrigerator of FIG. 1, FIG. 5 illustrates structures of a first spread prevention unit and a third spread prevention unit of the refrigerator of FIG. 1, FIG. 6 is a cross-sectional view showing a structure of a third spread prevention unit of the refrigerator of FIG. 1, FIG. 7 illustrates a structure of a second rail of a side frame of the refrigerator of FIG. 1, and FIG. 8 illustrates a structure of a second spread prevention unit of the refrigerator of FIG. 1.

The cantilever shelves 100 include a fixed shelf 200, hanger brackets 700 provided at both sides of the fixed shelf 200 so as to support the fixed shelf 200, a slide shelf 500 provided so as to be slidably movable in forward and rearward directions with respect to the fixed shelf 200, and a folding shelf 600 provided rotatably with respect to the fixed shelf 200.

The fixed shelf 200 includes an article support unit 201 for supporting articles, a pair of side frames 300, a front frame 210, and a rear frame 220. The article support unit 201 may be made of a tempered glass material. The article support unit 201 may be surrounded by the pair of side frames 300, the front frame 210, and the rear frame 220.

Here, the pair of side frames 300 protrude forward so as to support the slide shelf 500 and the folding shelf 600. The slide shelf 500 and the folding shelf 600 are arranged between the pair of side frames 300 while the slide shelf 500 and the folding shelf 600 are supported at their both ends by the pair of side frames 300, respectively.

The pair of hanger brackets 700 may be respectively coupled to both sides of the fixed shelf 200 to support the fixed shelf 200. The hanger brackets 700 may be made of a metal material, and firmly coupled to side surfaces of the fixed shelf 200 by screws (S). For this, screw fastening holes 701 and 301 may be formed in the hanger brackets 700 and the side frames 300, respectively.

A coupling ring 710 which is inserted into and fixed to the shelf hanger groove 81 of the shelf coupling unit 80 is formed at a rear side of the hanger brackets 700. As shown in FIG. 2, a receiving groove 12 may be formed in the rear wall 19 of the inner box 11 of the storage compartment, and the shelf coupling unit 80 may be inserted into and coupled to the receiving groove 12.

At least one support bar 390 for connecting a pair of hanger brackets 700 may be provided at a rear side of the pair of hanger brackets 700. In this instance, it is preferable that the at least one support bar 390 be at least disposed rearward from the slide shelf 500 so as not to be interrupted by operations of the slide shelf 500 and the folding shelf 600.

The shelf hanger groove 81 of the shelf coupling unit 80 may be mutually spaced apart from each other in a vertical direction so that the heights of the cantilever shelves 100 can be adjusted.

The slide shelf 500 may include an article support unit 501 for supporting articles, and a support frame 502 provided so as to surround edges of the article support unit 501. The article support unit 501 may be made of a tempered glass material.

The slide shelf 500 includes a pair of first rails 510 for enabling slidable movement. The pair of first rails 510 may be respectively formed so as to protrude at both sides of the slide shelf 500. The pair of first rails 510 may be formed long in forward and rearward directions. The first rails 510 may be slidably supported by second rails 310 and third rails 610 which will be described later.

In a front end of the first rails 510, stopper protrusions 520 for fixing a position of the slide shelf 500 may protrude downward when the slide shelf 500 is drawn out forward completely. The stopper protrusion 520 may be inserted into stopper grooves 311 which will be described later.

In addition, the slide shelf 500 may include first spread prevention protrusions 530 for preventing a space between the both side frames 300 from being increased by a load of foods when the load of foods is exerted on the slide shelf 500.

The first spread prevention protrusions 530 may be inserted into first spread prevention grooves 340, which will be described later, when the slide shelf 500 is maximally drawn out. Thus, the both side frames 300 are connected through the slide shelf 500, and therefore the space between the both side frames 300 is prevented from being increased.

The first spread prevention protrusions 530 and the first spread prevention grooves 340 form a first spread prevention unit.

In addition, third spread prevention protrusions 540 are respectively formed on both sides of the slide shelf 500 and third spread prevention grooves 350 in which the third spread prevention protrusions 540 are slidably inserted are formed in the side frames 300, so that the side frames 300 are prevented from being spread during movement of the slide shelf 500.

The third spread prevention protrusions 540 may be formed long in forward and rearward directions, and protrude downward approximately at the slide shelf 500. The third spread prevention grooves 350 may be also formed long in the forward and rearward directions.

The third spread prevention protrusions 540 and the third spread prevention grooves 350 form a third spread prevention unit.

The folding shelf 600 may include an article support unit 601 for supporting articles and a support frame 602 provided so as to surround edges of the article support unit 601. The article support unit 601 may be made of a tempered glass material.

A rotary shaft 640 that protrudes sideways is formed at a rear side of the folding shelf 600. The rotary shaft 640 may be inserted into a rotary shaft receiving unit 330 of the side frame 300. Thus, the folding shelf 600 may be rotated with respect to a rear end thereof.

The folding shelf 600 includes the third rails 610 for movably supporting the first rails 510 of the slide shelf 500 so that the slide shelf 500 is drawn rearward. Each of the third rails 610 is formed long in forward and rearward directions at both side surfaces of the folding shelf 600.

Thus, the first rails 510 may be supported by the second rails 310 of the side frames 300 when being drawn out forward completely, and then gradually supported by the third rails 610 of the folding shelf 600 while being drawn in.

In addition, the folding shelf 600 may include second spread prevention protrusions 620 and 621 for preventing a space between the side frames 300 from being increased by a load of foods supported by the folding shelf 600.

Each of the second spread prevention protrusions 620 may protrude downward at a front end of the left and right side support frames 602 of the folding shelf 600, and each of the second spread prevention protrusions 621 may protrude downward at a front end of the left and right third rails 610.

The second spread prevention protrusions 620 may be inserted into second spread prevention grooves 360 which will be described later, and the second spread prevention protrusions 621 may be inserted into the second spread prevention grooves 361 which will be described later.

Meanwhile, the both side frames 300 of the fixed shelf 200 include the second rails 310 which are formed long in forward and rearward directions so as to support the first rails 510.

At a front end of the second rail 310, stopper grooves 311 for fixing a position of the slide shelf 500 when the slide shelf 500 is drawn out forward completely may be formed. The slide shelf 500 may be fixed in such a manner that the stopper protrusions 520 of the slide shelf 500 are inserted into the stopper grooves 311.

In an upper portion of the second rails 310, guide units 320 for guiding movement of the slide shelf 500 when the slide shelf 500 slides in forward and rearward directions may be respectively provided.

In addition, the side frames 300 include folding shelf support units 331 for supporting the folding shelf 600 in a state in which the folding shelf 600 is unfolded, and rotary shaft receiving units 330 in which the rotary shaft 640 of the folding shelf 600 is rotatably inserted.

In addition, the side frames 300 include the first spread prevention grooves 340 for preventing a space between the side frames 300 from being increased, the second spread prevention grooves 360, and the third spread prevention grooves 350.

Here, the third spread prevention grooves 350 are not integrally formed when molding the side frames 300, and formed in such a manner that separate auxiliary frames 370 are respectively coupled to the side frames 300. The auxiliary frames 370 may be injection-molded members, and firmly coupled to the side frames 300 through screws (S).

Figure 9:
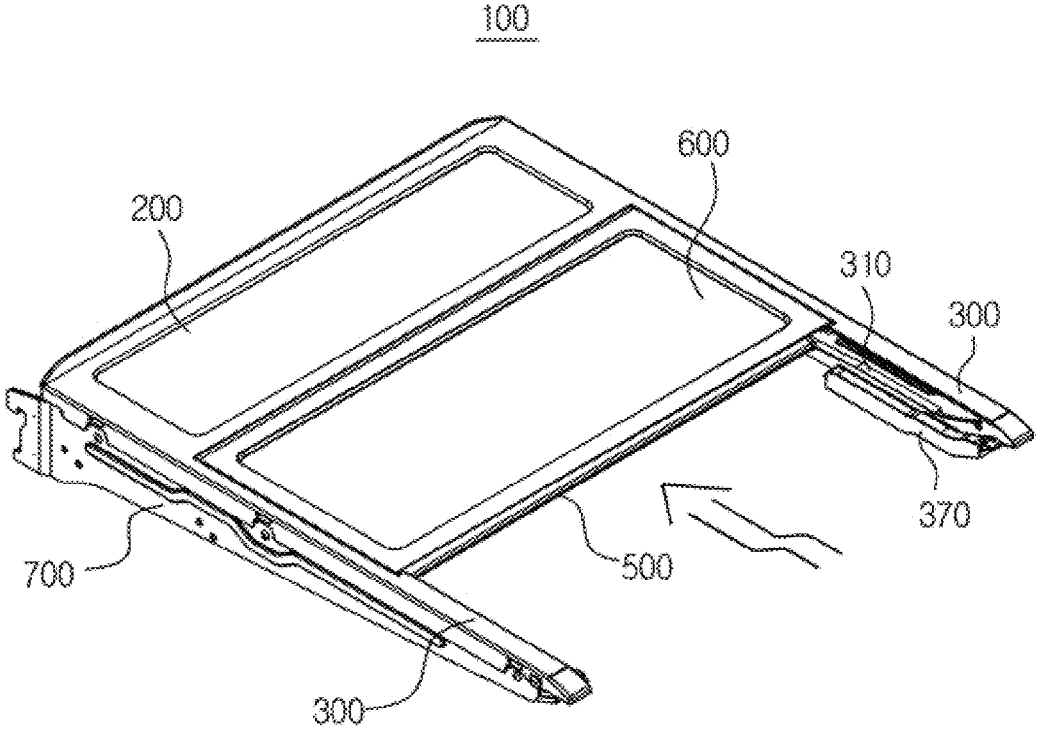
FIGS. 9 and 10 illustrate operations of the cantilever shelf of the refrigerator of FIG. 1.
Figure 10:
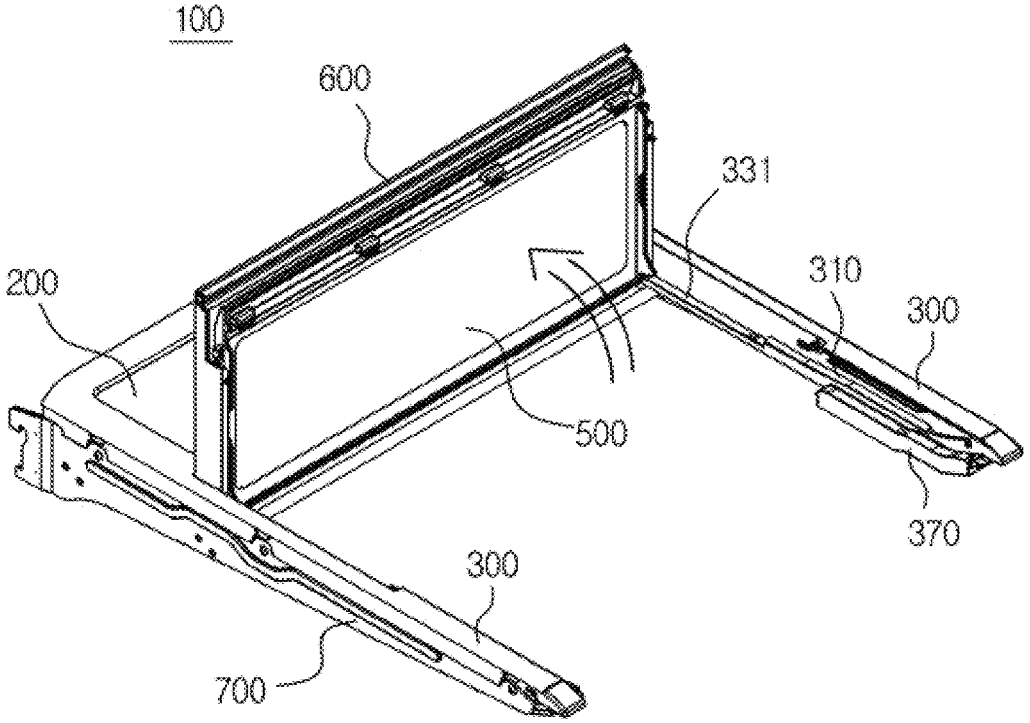

FIGS. 9 and 10 illustrate operations of the cantilever shelf of the refrigerator of FIG. 1.

As shown in FIG. 9, the slide shelf 500 of the cantilever shelf 100 may slide under a rear folding shelf 600, and therefore an opened space may be formed between the front both side frames 300 of the cantilever shelf 100. By the opened space, foods having relatively high heights or large sizes which cannot be stored before the slide shelf 500 is drawn in may be stored.

As shown in FIG. 10, the slide shelf 500 slides rearward and then the folding shelf 600 can be rotated upward together with the slide shelf 500, and therefore an opened space which is more increased in forward and rearward directions may be obtained.

Figure 11:
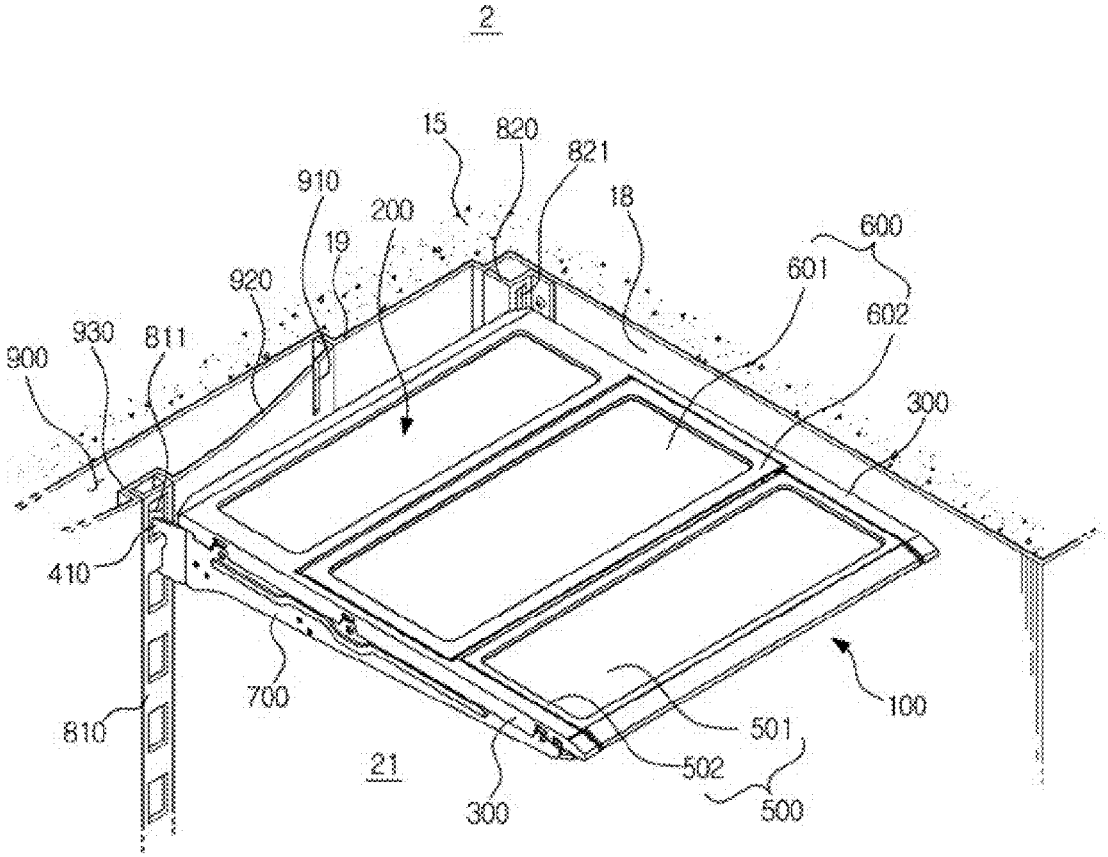
FIG. 11 illustrates a coupling structure of the cantilever shelf in accordance with another embodiment of the present disclosure.

FIG. 11 illustrates a coupling structure of the cantilever shelf in accordance with another embodiment of the present disclosure.

With reference to FIG. 11, a coupling structure of a cantilever shelf 100 of a refrigerator 2 in accordance with another embodiment of the present disclosure will be described in detail. The same configuration as the above-described embodiment may denote the same reference numerals, and specific descriptions thereof will be omitted.

The refrigerator 2 in accordance with another embodiment of the present disclosure includes a duct cover 910 coupled to an inner side of the rear wall 19 of the storage compartment 21. The duct cover 910 may form a cold air duct 900 together with the rear wall 19 of the storage compartment 21. The cold air duct 900 acts as evenly guiding cold air generated in an evaporator (not shown) into the storage compartment 21. A cold air discharging hole 920 for discharging the cold air is formed in the cold air duct 900.

The duct cover 910 may be formed so as to protrude forward from the outside towards the center thereof. In such a duct cover 910, a receiving groove 930 for receiving a shelf coupling unit 810 or 820 may be formed. The receiving groove 930 may be formed in a center portion of the duct cover 910. The shelf coupling unit 810 or 820 may be inserted into the receiving groove 930 to be coupled thereto.

The shelf coupling unit 810 includes shelf hanger grooves 811 in which the coupling ring 710 of the cantilever shelf 100 is inserted and fixed. The shelf hanger grooves 811 may be formed so as to be mutually spaced apart from each other in the vertical direction so that a height of the cantilever shelf 100 can be adjusted.

Meanwhile, the shelf coupling unit 820 may be coupled to the rear wall 19 of the inner box 11 of the storage compartment 21 or an inner surface of the side wall 17 or 18. As an example, as shown in FIG. 11, the shelf coupling unit 820 may be coupled to the rear wall 19 of the right edge of the storage compartment 21 and the inner surface of the right wall 18. The shelf coupling unit 820 may include shelf hanger grooves 821 in which the coupling ring 410 of the cantilever shelf 100 is inserted and fixed.

As is apparent from the above description, in accordance with the embodiments of the present disclosure, in the refrigerator having the cantilever shelf, a storage space may vary in various ways.

In addition, a phenomenon in which the both side frames of the fixed shelf that supports the slide shelf and the folding shelf are spread and a phenomenon in which the slide shelf is deviated from the fixed shelf may be prevented.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage compartment that is formed inside the main body;

a shelf coupling unit that is provided at an inner rear side of the storage compartment; and at least one cantilever shelf unit which is coupled to and supported by the shelf coupling unit, wherein the at least one cantilever shelf unit includes a fixed shelf;

side frames protruding forward from both sides of the fixed shelf;

hanger brackets which are respectively provided at the both sides of the fixed shelf so as to support the fixed shelf and having a coupling ring coupled to the shelf coupling unit;

a slide shelf that is provided so as to be slidably movable between the side frames;

a folding shelf that is rotatably provided at a rear side of the slide shelf between the side frames; and a spread prevention unit that prevents the side frames from being mutually spread by a load exerted on the at least one cantilever shelf, wherein the spread prevention unit includes first spread prevention protrusions respectively provided at both sides of the slide shelf and first spread prevention grooves respectively provided in the side frames, so that the first spread prevention protrusions are inserted into the first spread prevention grooves when the slide shelf is maximally drawn out.

2. The refrigerator according to claim 1, wherein the spread prevention unit includes second spread prevention protrusions respectively provided at both sides of the folding shelf and second spread prevention grooves respectively provided in the side frames, so that the second spread prevention protrusions are inserted into the second spread prevention grooves when the folding shelf is unfolded.

3. The refrigerator according to claim 1, wherein the spread prevention unit includes third spread prevention protrusions respectively provided at both sides of the slide shelf and third spread prevention grooves respectively provided in the side frames so that the side frames are prevented from being mutually spread during movement of the slide shelf.

4. The refrigerator according to claim 3, wherein the third spread prevention protrusions and the third spread prevention grooves are provided longitudinally in a movement direction of the slide shelf.

5. The refrigerator according to claim 3, further comprising an auxiliary frame that is coupled to the side frames so as to form the third spread prevention grooves.

6. The refrigerator according to claim 5, wherein the auxiliary frame is screw-coupled to the side frames.

7. The refrigerator according to claim 1, wherein the slide shelf includes a first rail that protrudes sideways so that the slide shelf slides, the side frame includes a second rail that slidably supports the first rail, and the folding shelf includes a third rail that slidably supports the first rail.

8. The refrigerator according to claim 7, further comprising a stopper unit that fixes the slide shelf in a state in which the slide shelf is maximally drawn in.

9. The refrigerator according to claim 8, wherein the stopper unit includes a stopper protrusion provided at a front end of the first rail, and a stopper groove provided at a front end of the second rail so that the stopper protrusion is inserted into the stopper groove.

10. The refrigerator according to claim 1, further comprising at least one support bar that connects the hanger brackets so as to support the hanger brackets, wherein the at least one support bar is arranged rearward from the slide shelf so as to prevent operations of the slide shelf and the folding shelf from being interrupted.

11. The refrigerator according to claim 1, wherein the shelf coupling unit includes a plurality of shelf hanger grooves in which the coupling ring is inserted and fixed and which are formed so as to be mutually spaced apart from each other in a vertical direction so that heights of the cantilever shelves are adjusted.

12. The refrigerator according to claim 1, wherein a receiving groove in which the shelf coupling unit is received and coupled is formed at a rear wall of the storage compartment.

13. The refrigerator according to claim 1, further comprising:

a cold air duct that supplies cold air into the storage compartment; and a duct cover that is coupled to the rear wall of the storage compartment so as to form the cold air duct, wherein a receiving groove in which the shelf coupling unit is received and coupled is formed on the duct cover.

14. A cantilever shelf unit of a refrigerator comprising:

a fixed shelf;

side frames protruding forward from both sides of the fixed shelf;

hanger brackets which are respectively coupled to the both sides of the fixed shelf and include a coupling ring;

a slide shelf that is provided so as to be slidably movable between the side frames;

a folding shelf that is rotatably provided at a rear side of the slide shelf between the side frames; and a spread prevention unit that prevents the side frames from being mutually spread by a load exerted on the cantilever shelf unit, wherein the spread prevention unit includes first spread prevention protrusions respectively provided at both sides of the slide shelf and first spread prevention grooves respectively provided in the side frames, so that the first spread prevention protrusions are inserted into the first spread prevention grooves when the slide shelf is maximally drawn out.

15. A refrigerator comprising:

a main body having a storage compartment therein; and a shelf coupled a rear of the storage compartment, wherein the shelf includes a fixed shelf including side frames;

hanger brackets formed at both sides of the fixed shelf;

a sliding shelf configured to slidably move between the side frames;

a folding shelf that is rotatably provided at a rear side of the sliding shelf between the side frames; and a spread prevention unit that prevents the side frames from being spread, wherein the spread prevention unit includes first spread prevention protrusions provided at both sides of the sliding shelf and first spread prevention grooves provided in the side frames, whereby the first spread prevention protrusions are inserted into the first spread prevention grooves when the sliding shelf is drawn out.

16. The refrigerator according to claim 15, wherein the spread prevention unit further includes second spread prevention protrusions provided at both sides of the folding shelf and second spread prevention grooves respectively provided in the side frames, whereby the second spread prevention protrusions are inserted into the second spread prevention grooves when the folding shelf is unfolded.

17. The refrigerator according to claim 16, wherein the spread prevention unit includes third spread prevention protrusions provided at both sides of the sliding shelf and third spread prevention grooves provided in the side frames, whereby the side frames are prevented from being spread during movement of the sliding shelf.

18. The refrigerator according to claim 17, wherein the third spread prevention protrusions and the third spread prevention grooves are provided longitudinally in a movement direction of the sliding shelf.

* * * * *